US010325552B2

(12) United States Patent
Jeong et al.

(10) Patent No.: US 10,325,552 B2
(45) Date of Patent: Jun. 18, 2019

(54) ORGANIC LIGHT EMITTING DISPLAY DEVICE

(71) Applicant: LG DISPLAY CO., LTD., Seoul (KR)

(72) Inventors: Jae Hyeong Jeong, Paju-si (KR); Sang Jae Park, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 273 days.

(21) Appl. No.: 14/508,792

(22) Filed: Oct. 7, 2014

(65) Prior Publication Data

US 2015/0097872 A1 Apr. 9, 2015

(30) Foreign Application Priority Data

Oct. 8, 2013 (KR) ..... 10-2013-0120061

(51) Int. Cl.
*G09G 3/3225* (2016.01)

(52) U.S. Cl.
CPC ... *G09G 3/3225* (2013.01); *G09G 2320/0233* (2013.01); *G09G 2320/0276* (2013.01);
(Continued)

(58) Field of Classification Search
CPC ..... G09G 3/32; G09G 3/3291; G09G 2300/0421; G09G 2300/0426; G09G 2300/043; G09G 2310/0264; G09G 2310/027; G09G 2310/0272; G09G 2310/0275; G09G 2310/0278; G09G 2320/00; G09G 2320/02; G09G 2320/0204; G09G 2320/0228; G09G 2320/0233; G09G 3/3225; G09G 2360/16; G09G 2320/0626; G09G 2320/043; G09G 2320/0276
(Continued)

(56) References Cited

U.S. PATENT DOCUMENTS 8,451,554 B2 * 5/2013 Kim ..... B29C 45/0001 349/155
2005/0259043 A1 * 11/2005 Kawaguchi ..... G09G 3/2037 345/63
(Continued)

FOREIGN PATENT DOCUMENTS

CN 101465096 A 9/2007
CN 101465096 A 6/2009
(Continued)

*Primary Examiner* — Grant Sitta
(74) *Attorney, Agent, or Firm* — Birch, Stewart, Kolasch & Birch, LLP

(57) ABSTRACT

Discussed is an organic light emitting display device capable of reducing power consumption and increasing lifespan of the device. The device includes a display panel including pixels in respective pixel regions defined by a plurality of gate lines, data lines and driving voltage lines, wherein each pixel includes an organic light emitting diode which emits light by a current, and a pixel circuit having a driving transistor for controlling a current flowing from the driving voltage line to the organic light emitting diode on the basis of data voltage; and a panel driver for converting frame video data into the data voltage, supplying the data voltage to each pixel, calculating peak luminance value and maximum grayscale value by analyzing the frame video data, and varying the driving voltage based on the peak luminance value and maximum grayscale value.

15 Claims, 6 Drawing Sheets

(52) U.S. Cl.
CPC ..... *G09G 2320/043* (2013.01); *G09G 2320/0626* (2013.01); *G09G 2360/16* (2013.01)

(58) Field of Classification Search
USPC ..... 345/76, 204
See application file for complete search history.

(56) References Cited

U.S. PATENT DOCUMENTS

2007/0126672 A1 6/2007 Tada et al.
2008/0007494 A1 1/2008 Kim et al.
2008/0018640 A1* 1/2008 Tada ..... G09G 3/3233 345/212
2009/0140959 A1* 6/2009 Nam ..... G09G 3/3233 345/76
2009/0160880 A1 6/2009 Park et al.
2009/0256854 A1* 10/2009 Mizukoshi ..... G09G 3/3233 345/589
2010/0214273 A1* 8/2010 Shirouzu ..... G09G 3/3233 345/205
2010/0253664 A1* 10/2010 Byun ..... G09G 3/3208 345/211
2011/0069098 A1 3/2011 Lee et al.
2011/0084992 A1* 4/2011 Ishizuka ..... G09G 3/3233 345/690
2011/0199395 A1* 8/2011 Nathan ..... G09G 3/3241 345/690
2011/0216097 A1* 9/2011 Yoo ..... G09G 5/10 345/690
2012/0026208 A1 2/2012 Kobiki et al.
2012/0038684 A1* 2/2012 Ryu ..... G09G 3/20 345/690
2012/0256936 A1 10/2012 Lee et al.
2012/0327067 A1* 12/2012 Kato ..... G09G 3/3258 345/212
2013/0120475 A1* 5/2013 Katsu ..... G09G 3/3426 345/690
2013/0127923 A1* 5/2013 An ..... G09G 5/10 345/690
2013/0162622 A1* 6/2013 Ebisuno ..... G09G 3/3208 345/212
2013/0176349 A1* 7/2013 Park ..... G09G 3/3258 345/690
2013/0194316 A1* 8/2013 Park ..... G09G 3/3225 345/690
2013/0335457 A1* 12/2013 Yano ..... G09G 3/30 345/690
2014/0125714 A1* 5/2014 Pyo ..... G09G 3/3233 345/691
2014/0354698 A1* 12/2014 Lee ..... G09G 3/3258 345/690
2015/0097764 A1* 4/2015 Pyo ..... G09G 3/3233 345/77
2015/0138251 A1* 5/2015 Pyo ..... G09G 3/3233 345/690
2015/0348505 A1* 12/2015 Pyo ..... G09G 5/10 345/589
2015/0364076 A1* 12/2015 Park ..... G09G 3/2081 345/77
2015/0364089 A1* 12/2015 Pyo ..... G09G 3/3258 345/77

FOREIGN PATENT DOCUMENTS

CN 102024423 A 4/2011
CN 102737577 A 10/2012
EP 2 453 433 A2 5/2012

* cited by examiner

ORGANIC LIGHT EMITTING DISPLAY DEVICE

CROSS REFERENCE TO RELATED APPLICATIONS

This application claims the benefit of the Korean Patent Application No. 10-2013-0120061 filed on Oct. 8, 2013, which is hereby incorporated by reference as if fully set forth herein.

BACKGROUND

Field of the Disclosure

Embodiments of the present invention relate to an organic light emitting display device, and more particularly, to an organic light emitting display device which is capable of reducing a power consumption and also increasing a lifespan of the device.

Discussion of the Related Art

According to a recent development of multimedia, there is an increasing demand for a flat panel display. In order to satisfy this increasing demand, various flat panel displays such as liquid crystal display, plasma display panel, field emission display and organic light emitting display are practically used. Among the various flat panel displays, the organic light emitting display device has been attracted as a next-generation flat panel display owing to advantages of rapid response speed and low power consumption. In addition, the organic light emitting display device can emit light in itself, whereby the organic light emitting display device does not cause a problem related with a narrow viewing angle.

Generally, the organic light emitting display device may display a predetermined image by applying a data voltage to each pixel, and controlling a current flowing to an organic light emitting diode from a driving voltage line according to a data current corresponding to the data voltage.

The organic light emitting display device emits light in itself. Thus, according as an image with a high grayscale is displayed on the organic light emitting display device, a power consumption is also increased in the organic light emitting display device, whereby a lifespan of the organic light emitting diode is shortened.

In order to overcome this problem, a peak luminance control algorithm for controlling a peak luminance of frame image in accordance with an average picture level (APL) of image is applied to the related art organic light emitting display device.

In the related art peak luminance control algorithm, as shown in FIG. 1, the average picture level (APL) is detected from video data by each frame unit, a peak luminance value of image is set in accordance with the detected average picture level (APL), and a peak luminance of image is adjusted by controlling a gamma voltage in accordance with the set peak luminance value. For example, the peak luminance of image is lowered when the average picture level (APL) is high, and the peak luminance of image is raised when the average picture level (APL) is low.

However, the organic light emitting display device, to which the related art peak luminance control algorithm is applied, is provided with the driving voltage line for supplying the driving voltage to the organic light emitting diode, wherein the driving voltage supplied to the driving voltage line is fixed to a predetermined D.C. voltage level.

Thus, the power consumption may unnecessarily occur in the image with the low peak luminance.

SUMMARY

Accordingly, embodiments of the present invention are directed to an organic light emitting display device that substantially obviates one or more problems due to limitations and disadvantages of the related art.

An aspect of embodiments of the present invention is directed to providing an organic light emitting display device which is capable of maintaining a peak luminance of image, reducing a power consumption and also increasing a lifespan of the device.

Additional advantages and features of embodiments of the invention will be set forth in part in the description which follows and in part will become apparent to those having ordinary skill in the art upon examination of the following or may be learned from practice of embodiments of the invention. The objectives and other advantages of embodiments of the invention may be realized and attained by the structure particularly pointed out in the written description and claims hereof as well as the appended drawings.

To achieve these and other advantages and in accordance with the purpose of embodiments of the invention, as embodied and broadly described herein, there is provided an organic light emitting display device that may include a display panel including a plurality of pixels respectively formed in pixel regions defined by a plurality of gate lines, data lines and driving voltage lines, wherein each pixel includes an organic light emitting diode which emits light by a current, and a pixel circuit having a driving transistor for controlling a current flowing from the driving voltage line to the organic light emitting diode on the basis of data voltage supplied to the data line; and a panel driver for converting frame video data into the data voltage, supplying the data voltage to each of the pixels, calculating a peak luminance value and a maximum grayscale value by analyzing the frame video data, and varying the driving voltage supplied to the driving voltage line on the basis of the peak luminance value and the maximum grayscale value. At this time, the panel driver controls a peak luminance of image by the frame video data displayed on the display panel through the use of peak luminance value.

It is to be understood that both the foregoing general description and the following detailed description of embodiments of the present invention are exemplary and explanatory and are intended to provide further explanation of the invention as claimed.

BRIEF DESCRIPTION OF THE DRAWINGS

The accompanying drawings, which are included to provide a further understanding of embodiments of the invention and are incorporated in and constitute a part of this application, illustrate embodiment(s) of the invention and together with the description serve to explain the principle of embodiments of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

On explanation about the embodiments of the present invention, the following details about the terms should be understood.

The term of a singular expression should be understood to include a multiple expression as well as the singular expression if there is no specific definition in the context. If using the term such as "the first" or "the second", it is to separate any one element from other elements. Thus, a scope of claims is not limited by these terms. Also, it should be understood that the term such as "include" or "have" does not preclude existence or possibility of one or more features, numbers, steps, operations, elements, parts or their combinations. It should be understood that the term "at least one" includes all combinations related with any one item. For example, "at least one among a first element, a second element and a third element" may include all combinations of the two or more elements selected from the first, second and third elements as well as each element of the first, second and third elements.

Hereinafter, an organic light emitting display device according to embodiments of the present invention will be described in detail with reference to the accompanying drawings.

Figure 1:
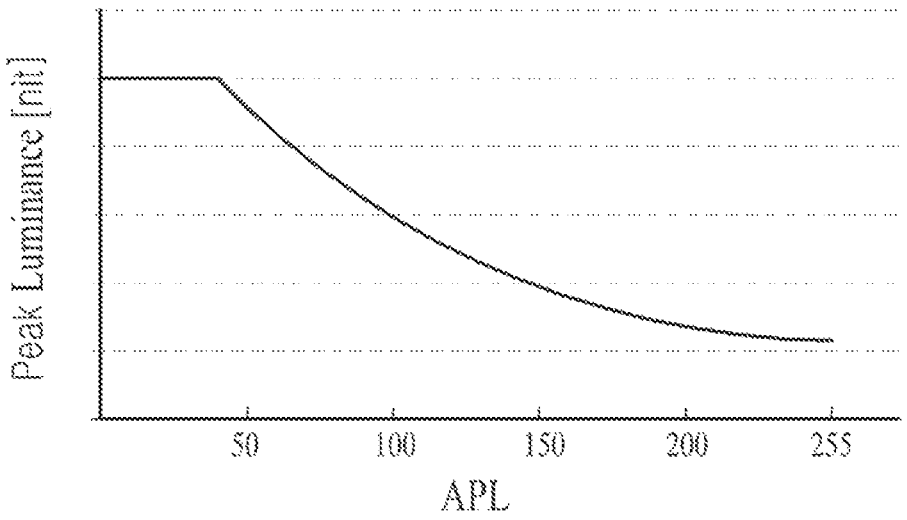
FIG. 1 Related Art
FIG. 1 is a graph illustrating a peak luminance curve of a related art peak luminance control algorithm.
Figure 2:
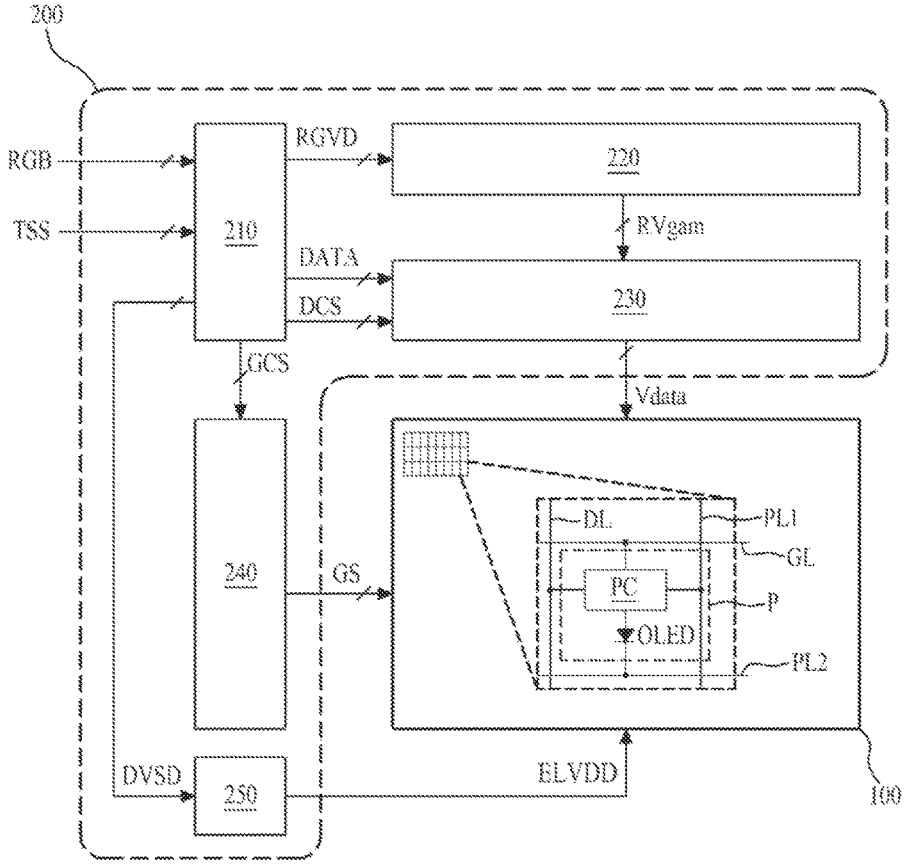
FIG. 2 illustrates an organic light emitting display device according to an embodiment of the present invention.

FIG. 2 illustrates an organic light emitting display device according to an embodiment of the present invention.

Referring to FIG. 2, the organic light emitting display device according to the embodiment of the present invention may include a display panel 100 and a panel driver 200. All of the components of the display device are operatively coupled and configured.

On the display panel 100, there are a plurality of pixels (P), wherein each pixel (P) includes an organic light emitting diode (OLED). According as the organic light emitting diode (OLED) for each pixel (P) emits light in accordance with a data voltage (Vdata) supplied from the panel driver 200, a predetermined color image is displayed through the light emitted from each pixel (P). To this end, the display panel 100 may include a plurality of data lines (DL) and gate lines (GL) crossing each other to define each pixel region, a plurality of driving voltage lines (PL1) provided in parallel to the plurality of data lines (DL) and connected with the respective pixels (P), and a cathode voltage line (PL2) connected with each pixel (P).

The plurality of data lines (DL) and gate lines (DL) are provided at fixed intervals, wherein each data line (DL) is formed in perpendicular to each gate line (GL).

The plurality of driving voltage lines (PL1) are provided in parallel to the plurality of data lines (DL), wherein each of driving voltage lines (PL1) is formed adjacent to each of data lines (DL) and is supplied with a driving voltage (ELVDD) from the panel driver 200. The cathode voltage line (PL2) is supplied with a cathode voltage of low potential voltage level or ground voltage level, wherein the cathode voltage is relatively lower than the driving voltage (ELVDD).

In response to a gate signal (GS) supplied from the gate line (GL) connected with each pixel (P), each of the pixels (P) emits a predetermined monochromatic light by a data current corresponding to the data voltage (Vdata) supplied from the data line (DL). To this end, each of the pixels (P) may include an organic light emitting diode (OLED) and a pixel circuit (PC).

The organic light emitting diode (OLED), which is connected between the pixel circuit (PC) and the cathode voltage line (PL2), emits a light in proportion to the data current supplied from the pixel circuit (PC), and thus emits a predetermined monochromatic light. To this end, the organic light emitting diode (OLED) may include an anode electrode (or pixel electrode) connected with the pixel circuit (PC), a cathode electrode (or reflective electrode) connected with the cathode voltage line (PL2), and an organic layer formed between the anode and cathode electrodes. In this case, the organic layer may be formed in a deposition structure of hole transport layer/organic light emitting layer/electron transport layer or a deposition structure of hole injection layer/hole transport layer/organic light emitting layer/electron transport layer/electron injection layer. Furthermore, the organic layer may include a functional layer for improving light-emitting efficiency and/or lifespan of the organic light emitting layer.

The pixel circuit (PC) controls the current flowing from the corresponding driving voltage line (PL1) to the organic light emitting diode (OLED) on the basis of the data voltage (Vdata) supplied from the panel driver 200 to the data line (DL) in response to the gate signal (GS) supplied from the panel driver 200 to the gate line (GL). To this end, the pixel circuit (PC) may include a driving transistor (not shown) for controlling the current flowing from the driving voltage line (PL1) to the organic light emitting diode (OLED) on the basis of the data voltage (Vdata), a switching transistor (not shown) for supplying the data voltage (Vdata) to a gate electrode of the driving transistor, and a storage capacitor (not shown) for maintaining a gate-to-source voltage of the driving transistor for one frame, wherein the storage capacitor is connected between gate and source electrodes of the driving transistor. In this case, the pixel circuit (PC) may include the two transistors and one capacitor, but not limited to this structure. In addition, the pixel circuit (PC) may include an additional transistor or capacitor corresponding to an internal compensation structure for compensating a variation of threshold voltage/mobility of the driving transistor inside the pixel (P) or an external compensation structure for sensing a variation of threshold voltage/mobility of the driving transistor and compensating the sensed variation through a data correction outside the display panel 100.

The panel driver 200 converts frame video data (RGB, frame video data), which is input by each frame unit, into the data voltage (Vdata); supplies the data voltage (Vdata) to each of the pixels (P); calculates a peak luminance value and a maximum grayscale value by analyzing the frame video data (RGB); and varies the driving voltage (ELVDD) supplied to the driving voltage line (PL1) on the basis of the peak luminance value and the maximum grayscale value. That is, the panel driver 200 maintains a peak luminance of image by varying the driving voltage (ELVDD) in accordance with the peak luminance value of image on the basis of the frame video data (RGB), and also reduce a power consumption, to thereby increase a lifespan of the organic light emitting diode (OLED). To this end, the panel driver 200 may include a timing controller 210, a reference gamma voltage generator 220, a data driver 230, a gate driver 240, and a driving voltage supplier 250.

The timing controller 210 calculates the peak luminance value and the maximum grayscale value by analyzing the frame video data (RGB), which input by each frame unit, on the basis of timing synchronized signal (TSS) which is input from the external, that is, system body (not shown) or graphic card (not shown); generates reference gamma voltage data (RGVD) based on the peak luminance value; and generates driving voltage setting data (DVSD) based on the peak luminance value and the maximum grayscale value. At the same time, the timing controller 210 aligns the frame video data (RGB) in accordance with a pixel arrangement structure of the display panel 100, and provides the aligned data (DATA) to the data driver 230. Also, the timing controller 210 generates a data control signal (DCS) and a gate control signal (GCS) on the basis of the timing synchronized signal (TSS).

The reference gamma voltage generator 220 generates a plurality of reference gamma voltages (RVgam) in accordance with the reference gamma voltage data (RGVD) supplied from the timing controller 210. The reference gamma voltage generator 220 sets a high potential voltage for generating the reference gamma voltage from a power supplier (not shown) in accordance with the reference gamma voltage data (RGVD); generates the plurality of reference gamma voltages (RVgam) having the different voltage levels through a voltage division between high and low potential voltages; and supplies the generated reference gamma voltages (RVgam) to the data driver 230. According to one embodiment of the present invention, the reference gamma voltage generator 220 may be formed of one programmable gamma integrated circuit for generating the plurality of reference gamma voltages (RVgam) used in common for the plurality of pixels (P) constituting a unit pixel. According to another embodiment of the present invention, the reference gamma voltage generator 220 may be formed of a color-programmable gamma integrated circuit for generating a plurality of reference gamma voltages by color used independently (or separately) for the plurality of pixels (P) constituting a unit pixel.

The data driver 230 is supplied with data (DATA) corresponding to each pixel (P) and the data control signal (DCS) supplied from the timing controller 210, and is also supplied with the plurality of reference gamma voltages (RVgam) from the reference gamma voltage generator 220. The data driver 230 samples the data (DATA) for each pixel (P), which is input by each one horizontal line unit, in accordance with the data control signal (DCS); converts the sampled data to the data voltage (Vdata) of analog type on the basis of the plurality of reference gamma voltages (RVgam); and supplies the data voltage (Vdata) of analog type to the corresponding data line (DL) of each pixel (P).

The gate driver 240 generates the gate signal (GS) in accordance with the gate control signal (GCS) supplied from the timing controller 210, and then sequentially supplies the gate signal (GS) to the plurality of gate lines (GL). The gate driver 240 may be formed of a shift register for sequentially outputting the gate signal (GS) in accordance with the gate control signal (GCS). The shift register may be directly formed on a substrate of the display panel 100 for a transistor formation process of each pixel (P), and then respectively connected with the plurality of gate lines (GL). In another way, the shift register may be formed in an integrated circuit (IC) type, and then respectively connected with the plurality of gate lines (GL).

The driving voltage supplier 250 generates the driving voltage (ELVDD) corresponding to the driving voltage setting data (DVSD) supplied from the timing controller 210, and supplies the generated driving voltage (ELVDD) to the plurality of driving voltage lines (PL1). The driving voltage supplier 250 may be formed of a digital-analog converter for converting the driving voltage setting data (DVSD) to the driving voltage (ELVDD) of analog type or a DC-DC converter for generating the driving voltage (ELVDD) through a pulse width modulation method based on the driving voltage setting data (DVSD).

In the organic light emitting display device according to the embodiment of the present invention, the driving voltage (ELVDD) supplied to the display panel 100 is varied in accordance with the peak luminance value and the maximum grayscale value calculated from the frame video data (RGB) so that it is possible to maintain the peak luminance of image and to reduce the power consumption, and furthermore to reduce the unnecessary power consumption occurring in the image with the low peak luminance, thereby reducing the power consumption of the organic light emitting display device, and extending the lifespan of the organic light emitting diode (OLED).

Figure 3:
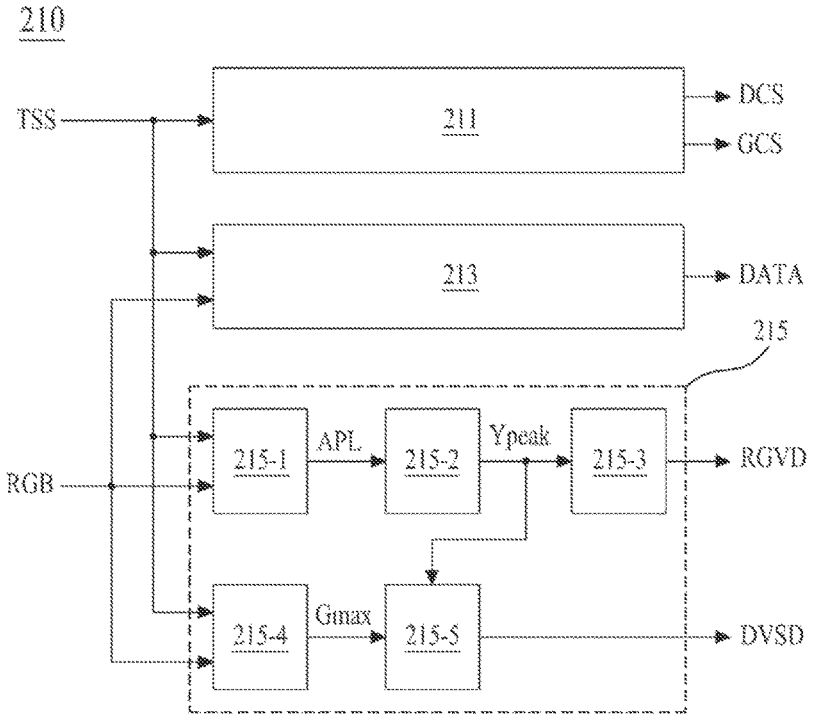
FIG. 3 illustrates a timing controller, shown in FIG. 2, according to a first embodiment of the present invention.

FIG. 3 illustrates the timing controller, which is shown in FIG. 2, according to the first embodiment of the present invention.

Referring to FIG. 3, the timing controller 210 according to the first embodiment of the present invention may include a control signal generator 211, a data processor 213, and a peak luminance controller 215.

The control signal generator 211 generates the data control signal (DCS) for controlling the driving timing of the data driver 230 and the gate control signal (GCS) for controlling the driving timing of the gate driver 240 on the basis of the timing synchronized signal (TSS) such as vertically synchronized signal, horizontally synchronized signal, data enable signal, main clock, and etc.

The data processor 213 aligns the frame video data (RGB) in accordance with the pixel arrangement structure of the display panel 100, and transmits the aligned data (DATA) to the data driver 230 in accordance with a predetermined data interface method.

The peak luminance controller 215 generates the reference gamma voltage data (RGVD) and the driving voltage setting data (DVSD) for reduction of the power consumption by varying the driving voltage (ELVDD) based on the frame video data (RGB). To this end, the peak luminance controller 215 may include a representative value calculating part

215-1, a peak luminance setting part 215-2, a reference gamma voltage setting part 215-3, a maximum grayscale value calculating part 215-4, and a driving voltage setting part 215-5.

The representative value calculating part 215-1 calculates a frame representative value (APL) by analyzing the grayscale value of the frame video data (RGB) which is input by each frame unit. In this case, the frame representative value (APL) may be the average grayscale value of the frame video data (RGB).

The peak luminance setting part 215-2 sets the peak luminance value (Ypeak) for reduction of the power consumption of the organic light emitting display device on the basis of frame representative value (APL) provided from the representative value calculating part 215-1. In this case, the peak luminance setting part 215-2 may set the peak luminance value (Ypeak) in accordance with the frame representative value (APL) by the use of peak luminance control look-up table (not shown) in which the peak luminance value (Ypeak) is mapped in accordance with the frame representative value (APL).

The reference gamma voltage setting part 215-3 sets the reference gamma voltage data (RGVD) based on the peak luminance value (Ypeak) provided from the peak luminance setting part 215-2 by changing the peak luminance of image by the frame video data (RGB) to the peak luminance value (Ypeak) for reduction of the power consumption.

The maximum grayscale value calculating part 215-4 calculates the maximum grayscale value (Gmax) by analyzing the grayscale value of the frame video data (RGB) input by each frame unit.

The driving voltage setting part 215-5 generates the driving voltage setting data (DVSD) based on the peak luminance value (Ypeak) provided from the peak luminance setting part 215-2 and the maximum grayscale value (Gmax) provided from the maximum grayscale value calculating part 215-4.

In detail, the driving voltage setting part 215-5 generates a driving voltage value corresponding to the peak luminance value (Ypeak); generates a grayscale compensation value corresponding to the maximum grayscale value (Gmax); and generates the driving voltage setting data (DVSD) by reflecting the grayscale compensation value (for example, multiplying operation) on the driving voltage value.

Figure 4:
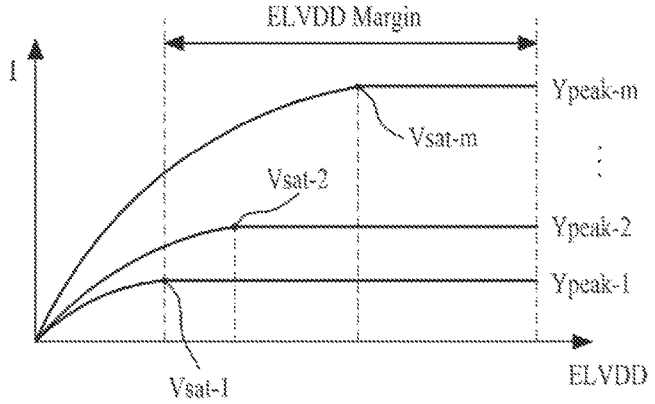
FIG. 4 illustrates a driving voltage margin in accordance with voltage-current characteristics of a driving transistor in the organic light emitting display device according to an embodiment of the present invention.
Figure 5:
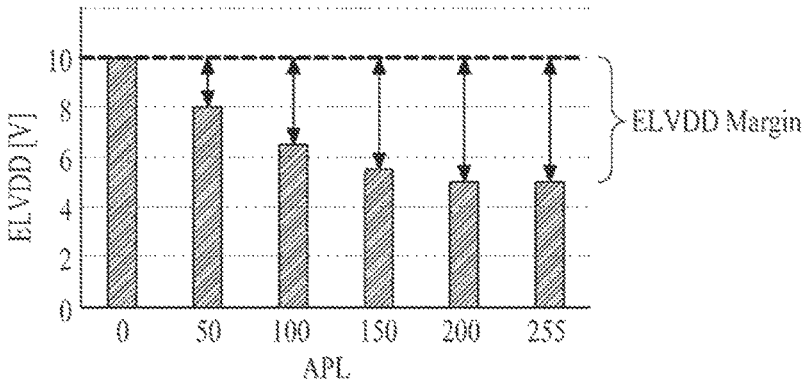
FIG. 5 illustrates a driving voltage margin in accordance with a frame representative value in the organic light emitting display device according to an embodiment of the present invention.

The driving voltage setting part 215-5 may generate the driving voltage value by the use of first look-up table (not shown) in which the driving voltage value is mapped in accordance with the peak luminance value (Ypeak). In this case, the driving voltage value in accordance with the peak luminance value (Ypeak) may be set based on current saturation characteristics in accordance with the voltage (V) of the driving transistor included in each pixel (P). In detail, as shown in FIG. 4, an ideal driving transistor has current saturation characteristics above a predetermined saturation voltage (Vsat-1 to Vsat-m). Accordingly, there exists a driving voltage margin (ELVDD Margin) between the driving voltage (ELVDD) needed to control the luminance of image to a low peak luminance value (Ypeak-1) and the driving voltage (ELVDD) needed to control the luminance of image to a high peak luminance value (Ypeak-m). In case of the ideal driving transistor, a deviation of current flowing in the driving transistor does not occur in a driving voltage margin (ELVDD Margin) region, whereby a luminance deviation does not occur in the driving voltage margin (ELVDD Margin) region. As shown in FIG. 5, the driving voltage margin (ELVDD Margin) may vary according to the peak luminance value (Ypeak-1 or Ypeak-m) based on the frame representative value (APL). In the first look-up table (not shown), the driving voltage value is mapped in accordance with the peak luminance value (Ypeak) based on the driving voltage margin (ELVDD Margin), wherein the driving voltage value may be set by a prior experiment.

Figure 6:
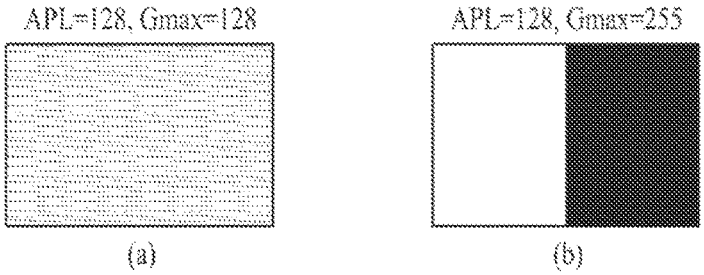
FIG. 6 illustrates a peak luminance control using a frame representative value and a maximum grayscale value in the organic light emitting display device according to an embodiment of the present invention.
Figure 7:
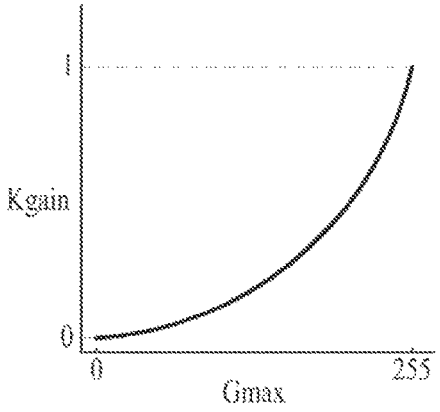
FIG. 7 is a graph illustrating one example of a grayscale compensation value based on a maximum grayscale value in the organic light emitting display device according to an embodiment of the present invention.

The driving voltage setting part 215-5 may generate the grayscale compensation value by the use of second look-up table (not shown) in which the grayscale compensation value is mapped in accordance with the maximum grayscale value (Gmax). In detail, the driving voltage setting part 215-5 maintains the peak luminance of image controlled by the peak luminance value (Ypeak) in accordance with the frame representative value (APL), and also generates the grayscale compensation value for additionally decreasing the voltage level of the driving voltage (ELVDD) in accordance with the maximum grayscale value (Gmax). For example, in case of the first and second images shown in (a) and (b) of FIG. 6, the frame representative value in each of the first and second images is the same, that is, '128', however, the maximum grayscale value (Gmax) of the first image is relatively lower than the maximum grayscale value (Gmax) of the second image, whereby the luminance of the first image is relatively lower than the luminance of the second image. Accordingly, the driving voltage setting part 215-5 generates the grayscale compensation value for additionally decreasing the driving voltage (ELVDD) in accordance with the maximum grayscale value (Gmax) so that it is possible to prevent the unnecessary power consumption occurring in the image with the low peak luminance, and thus to additionally reduce the power consumption. Accordingly, in the second look-up table, as shown in FIG. 7, the grayscale compensation value (Kgain) is mapped in accordance with the maximum grayscale value (Gmax). For example, the grayscale compensation value (Kgain) may be set within a range of 0 to 1 in accordance with the maximum grayscale value (Gmax) through a prior experiment based on the maximum grayscale value (Gmax).

The timing controller 210 according to the first embodiment of the present invention enables to reduce the unnecessary power consumption occurring in the image with the low peak luminance by varying the driving voltage (ELVDD) supplied to the display panel 100 in accordance with the maximum grayscale value and the peak luminance value calculated from the frame video data (RGB), to thereby extend the lifespan of the organic light emitting diode (OLED).

Figure 8:
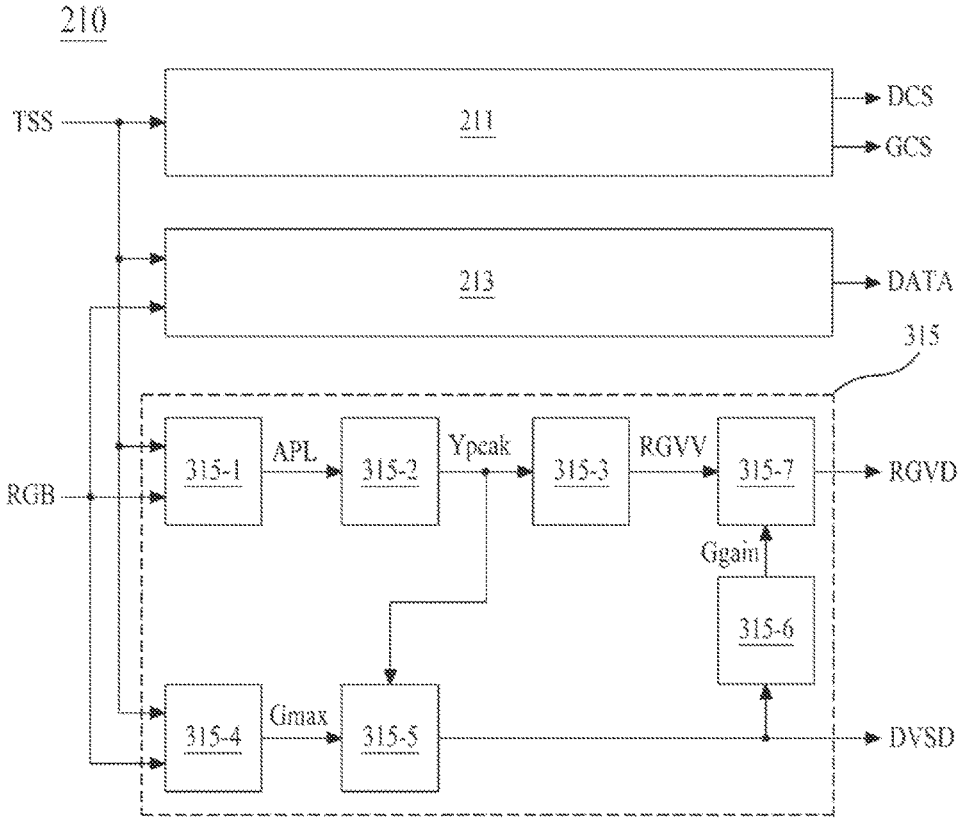
FIG. 8 illustrates a timing controller, shown in FIG. 2, according to a second embodiment of the present invention.

FIG. 8 illustrates the timing controller, which is shown in FIG. 2, according to the second embodiment of the present invention.

Referring to FIG. 8, the timing controller 210 according to the second embodiment of the present invention may include a control signal generator 211, a data processor 213, and a peak luminance controller 315.

The control signal generator 211 generates the data control signal (DCS) for controlling the driving timing of the data driver 230 and the gate control signal (GCS) for controlling the driving timing of the gate driver 240 on the basis of timing synchronized signal (TSS) such as vertically synchronized signal, horizontally synchronized signal, data enable signal, main clock, and etc.

The data processor 213 aligns the frame video data (RGB) in accordance with the pixel arrangement structure of the display panel 100, and transmits the aligned data (DATA) to the data driver 230 in accordance with a predetermined data interface method.

The peak luminance controller 315 generates the reference gamma voltage data (RGVD) and the driving voltage setting data (DVSD) for reduction of the power consumption by varying the driving voltage (ELVDD) based on the frame video data (RGB). That is, the peak luminance controller 315 calculates the peak luminance value (Ypeak) and the maximum grayscale value (Gmax) by analyzing the frame video data (RGB); generates the driving voltage setting data (DVSD) on the basis of the peak luminance value (Ypeak) and the maximum grayscale value (Gmax); and generates the reference gamma voltage data (RGVD) on the basis of the peak luminance value (Ypeak) and the driving voltage setting data (DVSD). To this end, the peak luminance controller 315 may include a representative value calculating part 315-1, a peak luminance setting part 315-2, a reference gamma voltage value setting part 315-3, a maximum grayscale value calculating part 315-4, a driving voltage setting part 315-5, a gamma compensation value generating part 315-6, and a reference gamma voltage setting part 315-7.

The representative value calculating part 315-1 calculates a frame representative value (APL) by analyzing the grayscale value of the frame video data (RGB) which is input by each frame unit. In this case, the frame representative value (APL) may be the average grayscale value of the frame video data (RGB).

The peak luminance setting part 315-2 sets the peak luminance value (Ypeak) based on the frame representative value (APL) provided from the representative value calculating part 315-1. In this case, the peak luminance setting part 315-2 may set the peak luminance value (Ypeak) in accordance with the frame representative value (APL) by the use of peak luminance control look-up table (not shown) in which the peak luminance value (Ypeak) is mapped in accordance with the frame representative value (APL).

The reference gamma voltage value setting part 315-3 sets a reference gamma voltage value (RGVV) based on the peak luminance value (Ypeak) provided from the peak luminance setting part 315-2 by changing the peak luminance of image by the frame video data (RGB) to the peak luminance value (Ypeak) for reduction of the power consumption.

The maximum grayscale value calculating part 315-4 calculates the maximum grayscale value (Gmax) by analyzing the grayscale value of the frame video data (RGB) input by each frame unit.

The driving voltage setting part 315-5 generates the driving voltage setting data (DVSD) on the basis of the peak luminance value (Ypeak) provided from the peak luminance setting part 315-2 and the maximum grayscale value (Gmax) provided from the maximum grayscale value calculating part 315-4. In detail, in the same manner as the driving voltage setting part 215-5 shown in FIG. 3, the driving voltage setting part 315-5 generates a driving voltage value corresponding to the peak luminance value (Ypeak); generates a grayscale compensation value corresponding to the maximum grayscale value (Gmax); and generates the driving voltage setting data (DVSD) by reflecting the grayscale compensation value (for example, multiplying operation) on the driving voltage value.

The gamma compensation value generating part 315-6 generates a gamma compensation value (Ggain) based on the driving voltage setting data (DVSD). In detail, the gamma compensation value generating part 315-6 calculates a data deviation between the driving voltage setting data (DVSD) and reference driving voltage data corresponding to a maximum voltage level of the driving voltage (ELVDD) supplied to the display panel 100 when the image is displayed in the highest peak luminance; and generates the gamma compensation value (Ggain) based on the calculated data deviation.

Figure 9:
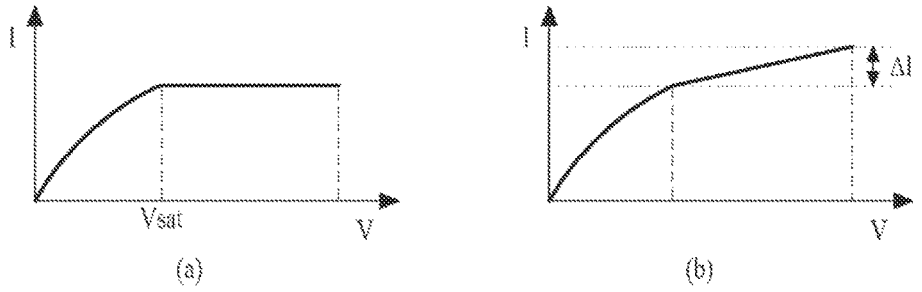
FIG. 9 illustrates a luminance lowering caused by a current deviation in accordance with current saturation characteristics of a virtual driving transistor in the organic light emitting display device according to an embodiment of the present invention.
Figure 10:
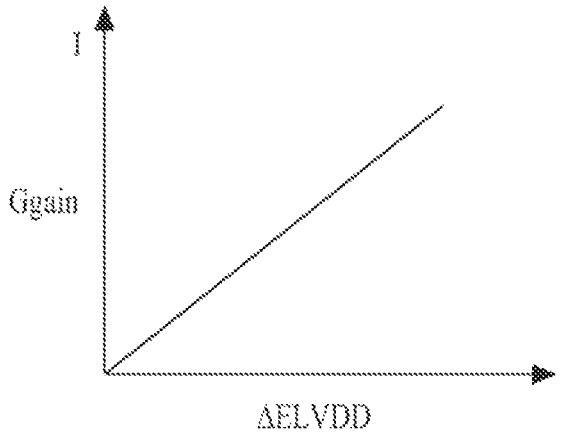
FIG. 10 is a graph illustrating one example of a gamma compensation value in accordance with a driving voltage deviation in the organic light emitting display device according to an embodiment of the present invention.

Meanwhile, as shown in (a) of FIG. 9, a current (I) flowing in an ideal driving transistor is saturated at a predetermined value above a predetermined saturation voltage (Vsat). Virtually, the current (ΔI) flowing in the driving transistor above the predetermined saturation voltage (Vsat) is not saturated at the predetermined value due to parasitic capacitance. Instead, as shown in (b) of FIG. 9, the current is linearly increased. Thus, the luminance may be lowered when varying the driving voltage (ELVDD) based on the aforementioned peak luminance value (Ypeak) and the maximum grayscale value (Gmax). In this reason, the gamma compensation value (Ggain) is applied to compensate for the above luminance lowering. Accordingly, the gamma compensation value generating part 315-6 may generate the gamma compensation value (Ggain) by the use of third look-up table (not shown) in which the gamma compensation value (Ggain) is mapped in accordance with the data deviation between the reference driving voltage data and the driving voltage setting data (DVSD). In this case, as shown in FIG. 10, the gamma compensation value (Ggain) may be set to be increased in accordance with the driving voltage deviation (ΔELVDD) corresponding to the data deviation between the reference driving voltage data and the driving voltage setting data (DVSD), and the gamma compensation value (Ggain) may be set by a prior experiment.

Referring once again to FIG. 8, the reference gamma voltage setting part 315-7 sets the reference gamma voltage data (RGVD) by correcting the reference gamma voltage value (RGVV) supplied from the reference gamma voltage value setting part 315-3 in accordance with the gamma compensation value (Ggain) supplied from the gamma compensation value generating part 315-6. In this case, the reference gamma voltage setting part 315-7 may generate the reference gamma voltage data (RGVD) by multiplying the reference gamma voltage value (RGVV) and the gamma compensation value (Ggain).

The timing controller 210 according to the second embodiment of the present invention enables to maintain the peak luminance of image, to reduce the unnecessary power consumption and to extend the lifespan of the organic light emitting diode (OLED) by varying the driving voltage (ELVDD) supplied to the display panel 100 in accordance with the maximum grayscale value and the peak luminance value calculated from the frame video data (RGB), and also compensating for the gamma voltage through the gamma compensation value (Ggain) in accordance with the driving voltage deviation (ΔELVDD) based on the varied driving voltage (ELVDD).

According to one or more embodiments of the present invention, the peak luminance of image is maintained and the power consumption is reduced by varying the driving voltage (ELVDD) supplied to the display panel 100 on the basis of the frame video data (RGB). Particularly, it is possible to reduce the unnecessary power consumption occurring in the image with the low peak luminance. Accordingly, the organic light emitting display device according to the present invention enables to reduce the power consumption and also to extend the lifespan of the organic light emitting diode (OLED).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting display device comprising:

a display panel including a plurality of pixels respectively formed in pixel regions defined by a plurality of gate lines, data lines and driving voltage lines, wherein each of the pixels includes an organic light emitting diode which emits light by a current, and a pixel circuit having a driving transistor for controlling a current flowing from the corresponding driving voltage line to the corresponding organic light emitting diode on the basis of a data voltage supplied to the corresponding data line and a driving voltage supplied to the corresponding driving voltage line; and a panel driver including a driving voltage supplier for:

converting frame video data into the data voltage, supplying the data voltage to each of the pixels, calculating a frame representative value by analyzing grayscale values of the frame video data, calculating a peak luminance value based on the frame representative value and calculating a maximum grayscale value by analyzing the grayscale values of the frame video data to decrease the driving voltage, generating driving voltage setting data based on the maximum grayscale value and a driving voltage margin according to the peak luminance value, wherein the driving voltage margin varies based on the peak luminance value, and the peak luminance value is set based on the frame representative value, changing the driving voltage based on the driving voltage setting data to generate an adjusted driving voltage, and supplying the adjusted driving voltage to the plurality of driving voltage lines.

2. The organic light emitting display device according to claim 1, wherein the panel driver controls a peak luminance of image by the frame video data displayed on the display panel using the peak luminance value.

3. The organic light emitting display device according to claim 2, wherein the panel driver includes:

a timing controller including a processor, the timing controller for:

calculating the peak luminance value and the maximum grayscale value by analyzing the frame video data, generating reference gamma voltage data based on the peak luminance value, and generating the driving voltage setting data based on the peak luminance value and the maximum grayscale value, and generating a plurality of reference gamma voltages based on the reference gamma voltage data;

a data driver for converting the frame video data, which is input from the timing controller on the basis of the plurality of reference gamma voltages, into the data voltage, and supplying the data voltage to the corresponding data line; and a gate driver for sequentially supplying a gate signal to the plurality of gate lines under control of the timing controller, and wherein the driving voltage supplier for generating the driving voltage corresponding to the driving voltage setting data, and supplying the driving voltage to the plurality of driving voltage lines.

4. The organic light emitting display device according to claim 3, wherein the timing controller generates the reference gamma voltage data and the driving voltage setting data, calculates the frame representative value by analyzing the frame video data, sets the peak luminance value based on the frame representative value, sets the reference gamma voltage data to change the peak luminance of image by the frame video data to the peak luminance value on the basis of the peak luminance value, calculates the maximum grayscale value by analyzing the frame video data, and generates the driving voltage setting data based on the peak luminance value and the maximum grayscale value.

5. The organic light emitting display device according to claim 4, wherein the timing controller generates the driving voltage value corresponding to the peak luminance value, generates the grayscale compensation value corresponding to the maximum grayscale value, and generates the driving voltage setting data by reflecting the grayscale compensation value on the driving voltage value.

6. The organic light emitting display device according to claim 5, wherein the timing controller generates the driving voltage value by using a first look-up table in which the driving voltage value is mapped in accordance with the peak luminance value, and generates the grayscale compensation value by using a second look-up table in which the grayscale compensation value for additionally reducing the driving voltage is mapped in accordance with the maximum grayscale value.

7. The organic light emitting display device according to claim 4, wherein the timing controller generates a gamma compensation value based on the driving voltage setting data, and sets the reference gamma voltage data by correcting the reference gamma voltage value based on the gamma compensation value.

8. The organic light emitting display device according to claim 7, wherein the timing controller generates the driving voltage value corresponding to the peak luminance value, generates the grayscale compensation value corresponding to the maximum grayscale value, and generates the driving voltage setting data by reflecting the grayscale compensation value on the driving voltage value.

9. The organic light emitting display device according to claim 8, wherein the timing controller generates the driving voltage value by using a first look-up table in which the driving voltage value is mapped in accordance with the peak luminance value, and generates the grayscale compensation value by using a second look-up table in which the grayscale compensation value for additionally reducing the driving voltage is mapped in accordance with the maximum grayscale value.

10. The organic light emitting display device according to claim 7, wherein the timing controller calculates a data deviation between the reference driving voltage data and the driving voltage setting data, and generates the gamma compensation value based on the calculated data deviation.

11. The organic light emitting display device according to claim 10, wherein the timing controller generates the gamma compensation value by using a third look-up table in which the gamma compensation value is mapped in accordance with the data deviation, and the gamma compensation value is increased according to the increase of data deviation.

12. The organic light emitting display device according to claim 1, wherein the frame representative value is an average grayscale value of the frame video data.

13. The organic light emitting display device according to claim 1, wherein the peak luminance value is set in accordance with the frame representative value by a look-up table, and wherein the look-up table maps peak luminance values to corresponding frame representative values, respectively.

14. The organic light emitting display device according to claim 1, wherein the driving voltage supplier is a digital-to-analog converter for converting the driving voltage setting data to the adjusted driving voltage.

15. The organic light emitting display device according to claim 1, wherein the driving voltage supplier is a DC-to-DC converter for generating the adjusted driving voltage through pulse width modulation based on the driving voltage setting data.

* * * * *